US006315225B1

(12) United States Patent
Karra

(10) Patent No.: US 6,315,225 B1
(45) **Date of Patent: *Nov. 13, 2001**

(54) ANTI-SPIN METHOD AND APPARATUS FOR CONICAL/GYRATORY CRUSHERS

(75) Inventor: Vijia Kumar Karra, Franklin, WI (US)

(73) Assignee: Metso Minerals (Milwaukee) Inc., Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/452,441

(22) Filed: Dec. 2, 1999

Related U.S. Application Data

(63) Continuation of application No. 09/122,814, filed on Jul. 27, 1998, now Pat. No. 6,065,698, which is a continuation-in-part of application No. 08/754,924, filed on Nov. 22, 1996, now Pat. No. 5,799,855.

(51) Int. Cl.[7] ..... B02C 2/04
(52) U.S. Cl. ..... 241/207
(58) Field of Search ..... 241/207–216

(56) References Cited

U.S. PATENT DOCUMENTS

| | | | |
|---|---|---|---|
| 1,254,192 | 1/1918 | Bartley . | |
| 2,134,876 | 11/1938 | Hull et al. . | |
| 2,224,542 | 12/1940 | Gruender et al. . | |
| 2,540,358 | 2/1951 | Symons . | |
| 3,454,230 | 7/1969 | Allen . | |
| 3,750,809 | 8/1973 | DeDiemar et al. . | |
| 4,192,472 | 3/1980 | Johnson . | |
| 4,225,092 | 9/1980 | Matter et al. . | |
| 4,359,208 | 11/1982 | Kelm et al. . | |
| 4,384,684 | 5/1983 | Karra . | |
| 4,391,414 | 7/1983 | Reiter . | |
| 4,406,416 | 9/1983 | Tateishi . | |
| 4,560,113 | 12/1985 | Szalanski . | |
| 4,575,014 | 3/1986 | Szalanski et al. . | |
| 4,620,185 | 10/1986 | Plahmer . | |
| 4,658,638 | 4/1987 | Plahmer . | |
| 4,659,026 | 4/1987 | Krause et al. . | |
| 4,703,896 | 11/1987 | Fabian et al. . | |
| 4,733,825 | 3/1988 | Boyes et al. . | |
| 4,750,679 | 6/1988 | Karra et al. . | |
| 4,756,484 | 7/1988 | Bechler et al. . | |
| 4,956,078 | 9/1990 | Magerowski et al. . | |
| 5,029,761 | 7/1991 | Bechler . | |
| 5,172,869 | 12/1992 | Kitsukawa et al. . | |
| 5,638,296 | 6/1997 | Johnson et al. . | |
| 5,732,896 | 3/1998 | Jakob et al. . | |
| 5,775,607 | 7/1998 | Bayliss et al. . | |
| 5,799,885 | 9/1998 | Karra . | |
| 6,065,698 * | 5/2000 | Karra | 241/207 |

FOREIGN PATENT DOCUMENTS

| | | |
|---|---|---|
| 425642 | 7/1972 | (CN) . |
| 1338883 | 12/1985 | (CN) . |
| 1570015 | 6/1980 | (GB) . |
| 54-39261 | 3/1979 | (JP) . |
| 54-3955 | 12/1979 | (JP) . |
| 55-3853 | 1/1980 | (JP) . |
| 904773 | 2/1982 | (SU) . |

* cited by examiner

*Primary Examiner*—Mark Rosenbaum
(74) *Attorney, Agent, or Firm*—Foley & Lardner

(57) ABSTRACT

An anti-spin mechanism includes fingers disposed at a bottom portion of a crushing gap. In this way, the anti-spin mechanism does not interfere with the crushing apparatus as do clutch-based, anti-spin mechanisms. The anti-spin mechanism relies on mechanical prohibition of rotation of the crusher head with respect to the bowl due to finger-on-finger engagement. The fingers can be mounted on mantles, bowl liners, bowls, housing, or crushing heads to achieve anti-spin functions.

21 Claims, 10 Drawing Sheets

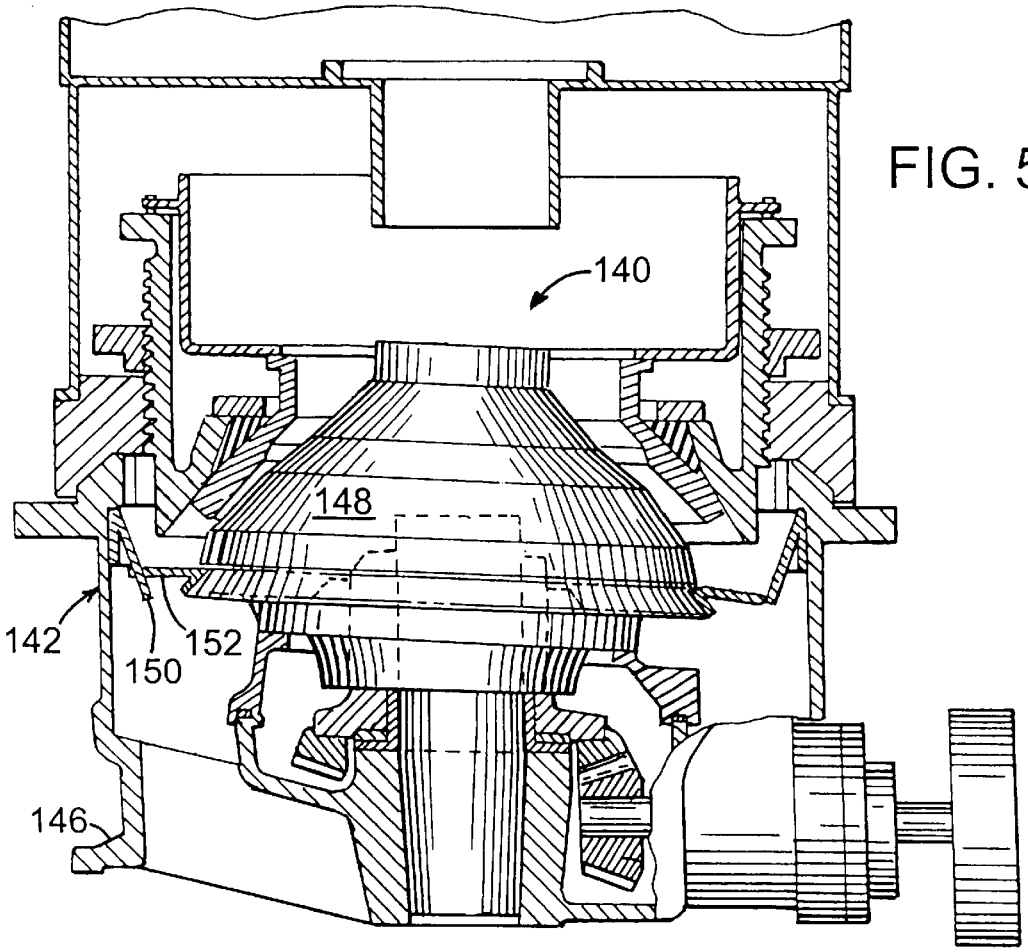
FIG. 5
FIG. 6
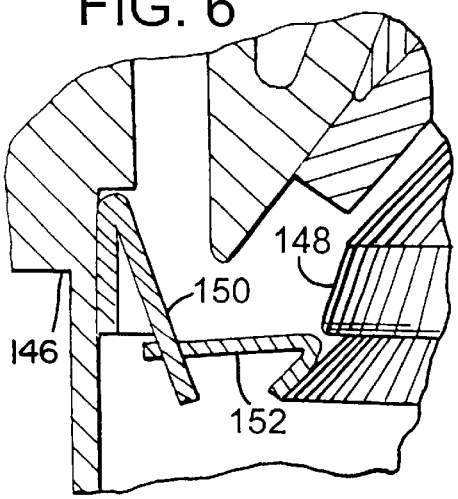
FIG. 7
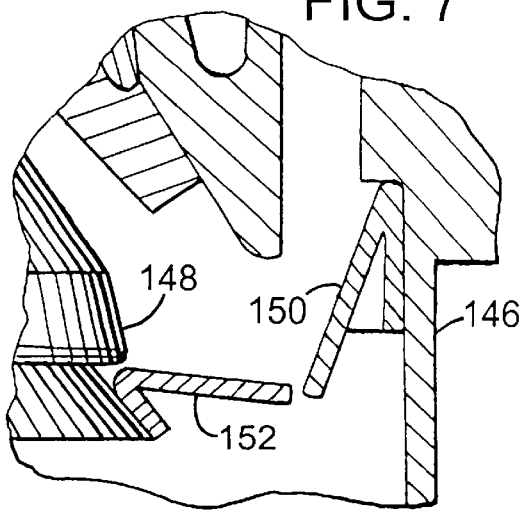

ANTI-SPIN METHOD AND APPARATUS FOR CONICAL/GYRATORY CRUSHERS

CROSS REFERENCE TO RELATED APPLICATIONS

The present application is a continuation of U.S. patent application Ser. No. 09/122,814 filed on Jul. 27, 1998, now U.S. Pat. No. 6,065,698, which is a continuation-in-part application of U.S. patent application Ser. No. 08/754,924, filed on Nov. 22, 1996, by Karra, entitled "High Reduction Ratio Crushing in Conical/Gyratory Crushers" and issued as U.S. Pat. No. 5,799,855 on Sep. 1, 1998 and is related to U.S. patent application Ser. No. 08/754,854, filed on Nov. 22, 1996, by Karra, entitled "Conical/Gyratory Grinding and Crushing Apparatus"; and issued as U.S. Pat. No. 5,806,722 on Sep. 15, 1998 and U.S. patent application Ser. No. 08/754,925, filed on Nov. 22, 1996 and issued Jun. 23, 1998 as U.S. Pat. No. 5,769,339 all assigned to the Assignee of the present application.

FIELD OF THE INVENTION

The present invention generally relates to conical or gyratory crushers. More specifically, the present invention relates to an anti-spin method and apparatus for such crushers.

BACKGROUND OF THE INVENTION

Rock crushers, such as, conical or gyratory crushers, include assemblies which gyrate or otherwise move to crush material. The assemblies are often moved by an eccentric mechanism, which can be driven by various power sources. A conical or gyratory crusher typically includes a frame having a central hub surrounded by an annular shell. An annular ring is mounted on the annular shell and is capable of vertical movement with respect to the shell. A bowl, which can be provided with a liner, is mounted on the annular ring.

A conical head assembly, which is often provided with a liner, or a mantle, is supported by a bearing mechanism on a stationary shaft supported by the central hub. The eccentric mechanism, mounted for rotation about the stationary shaft, provides gyrational movement of the conical head assembly relative to the bowl. By adjusting the vertical height of the bowl with respect to the conical head, a crushing cavity (gap or space) between the bowl liner (or bowl) and the mantle (or head) can be adjusted to determine the particle size to which the material will be is crushed.

Conventional crushers can be susceptible to unsafe operation and excessive wear if the mantle or head is improperly allowed to spin with respect to the bowl or bowl liner. For example, if a conical or gyratory crusher is operated without any material in the crushing cavity (such as, at start-up and shut-down), the rotational motion of the eccentric mechanism can cause the crushing head to turn with respect to the bowl. When rocks enter the cavity, while the head is improperly spinning, some rocks may eject upward from the crusher. Also, due to the high relative motion between the spinning head and the rock in the cavity, there will be excessive wear on the mantle and liner (e.g., the liners), leading to more frequent changes of the liners and reducing overall productivity of the crusher. The spinning action can cause the mantle and bowl liner or head and bowl to wear excessively, thereby reducing the operating life of such components and increasing the amount of maintenance required for the crusher. The spinning action can also create undesirable high stresses in conical or gyratory crushers.

Heretofore, some rock crushers have included a clutch-based anti-spin mechanism to prevent undesirable spinning action during no-load or underload conditions. With reference to FIG. 1, an exemplary conventional crushing system 10 is shown as an Omnicone® crusher, manufactured by Nordberg, Inc. Crusher 10 includes a mantle 12 sitting on a crusher head 11. Crusher head 11 gyrates within main frame 15 to crush rock or other material in crushing area or gap 18 between mantle 12 and a bowl liner 16. Bowl liner 16 is mounted on a bowl 13 that is coupled to an annular ring 14. Annular ring 14 sits upon main frame 15.

System 10 includes a clutch-based, friction-based anti-spin mechanism 20 that is discussed in more detail with reference to FIG. 2. Clutch-based, anti-spin mechanism 20 includes a feed plate 22, a locking nut 24, a locking bar 25, a coupling slider 26, a guide guard 27, a coupling adaptor 28, and a back-stop clutch 30. Mechanism 20 is a relatively complex device which operates to prevent head 11 from spinning with respect to bowl 13 (FIG. 1) when system 10 is in an underload or no-load condition.

Mechanism 20 (FIG. 1) is attached to a top portion of head 11 (e.g., underneath the locking bolt which holds mantle 12 to crushing head 11). The placement of anti-spin mechanism 20 at the top of crushing head 11 (near the top of crushing gap 18) constrains the opening of the crusher. For example, the anti-spin mechanism in Omnicone® crushers, manufactured by Nordberg, Inc., is located at a pivot point of the head motion, which can impinge the available feed-opening sizes and decrease the mobility of large pieces of material (e.g., such as rock), in the crushing cavity. Because of these limitations, some crushers, such as, HP® crushers, manufactured by Nordberg, Inc., do not utilize an anti-spin mechanism. Clutch-based mechanisms must have a pivot point below the top end of the crusher head, which constrains material flow or movement at that location. Additionally, conventional anti-spin mechanisms can be expensive, fail quite often, and can be difficult to service. In fact, some anti-spin mechanisms are replaced rarely due to the described maintenance problems.

Thus, there is a need for a less expensive anti-spin mechanism that can be utilized with a variety of rock crushers. Further still, there is a need for an anti-spin mechanism that does not decrease the mobility of large pieces of rock at the top end of the crushing cavity and does not impinge upon the feed openings.

SUMMARY OF THE INVENTION

The present invention relates-to a rock crusher including a bowl, a crusher head and an anti-spin apparatus. The crusher head is disposed in the bowl. A crushing area is located between the head and the bowl. Material is provided to a top of the crushing area and exits at a bottom of the crushing area. The anti-spin apparatus is disposed closer to the bottom than to the top.

The present invention further relates to a bowl liner for a rock crusher. The rock crusher gyrates to crush a material provided to a crushing gap between a crusher head and a bowl. The material enters the crushing gap from a top end and leaves the crushing gap from a bottom end. The rock crusher has at least one first anti-spin element closer to a bottom than to a top end of the crushing space. The bowl liner includes at least one second anti-spin element disposed to engage the first anti-spin element. The second anti-spin element prevents the crusher head from spinning with respect to the bowl.

The present invention also relates to a rock crusher including a bowl, a crusher head, and an anti-spin means.

The crusher head is disposed in the bowl. The anti-spin means prevents the crusher head from spinning with respect to the bowl. The anti-spin means is not located at the top of the crusher head.

The present invention still further relates to a mantle for a rock crusher. The rock crusher gyrates to crush a material provided to a crushing gap between a crusher head and a bowl. The material enters the crushing gap from a top end and leaves the crushing gap from a bottom end. The rock crusher has at least one first anti-spin element closer to the bottom end than to the top end. The mantle includes at least one second anti-spin element disposed to engage the first anti-spin element. The second anti-spin element prevents the crusher head from spinning with respect to the bowl.

BRIEF DESCRIPTION ON THE DRAWINGS

The present invention will hereafter be described, wherein like numerals denote like elements, and:

FIG. 1 is a cross-sectional view of a conventional conical crusher including a clutch-based, anti-spin mechanism;

FIG. 2 a more detailed cross-sectional view of the conventional clutch-based, anti-spin mechanism for the crusher illustrated in FIG. 1;

FIG. 5 is a cross-sectional view of yet another conical crusher having an anti-spin mechanism in accordance with an exemplary embodiment of the present invention;

FIG. 6 is a more detailed schematic drawing of the anti-spin mechanism in the closed position of the liners illustrated in FIG. 5;

FIG. 7 is a more detailed schematic drawing of the anti-spin mechanism illustrated in the open position of the liners in FIG. 5;

DETAILED DESCRIPTION OF PREFERRED EXEMPLARY EMBODIMENTS IN THE PRESENT INVENTION

Figure 1:
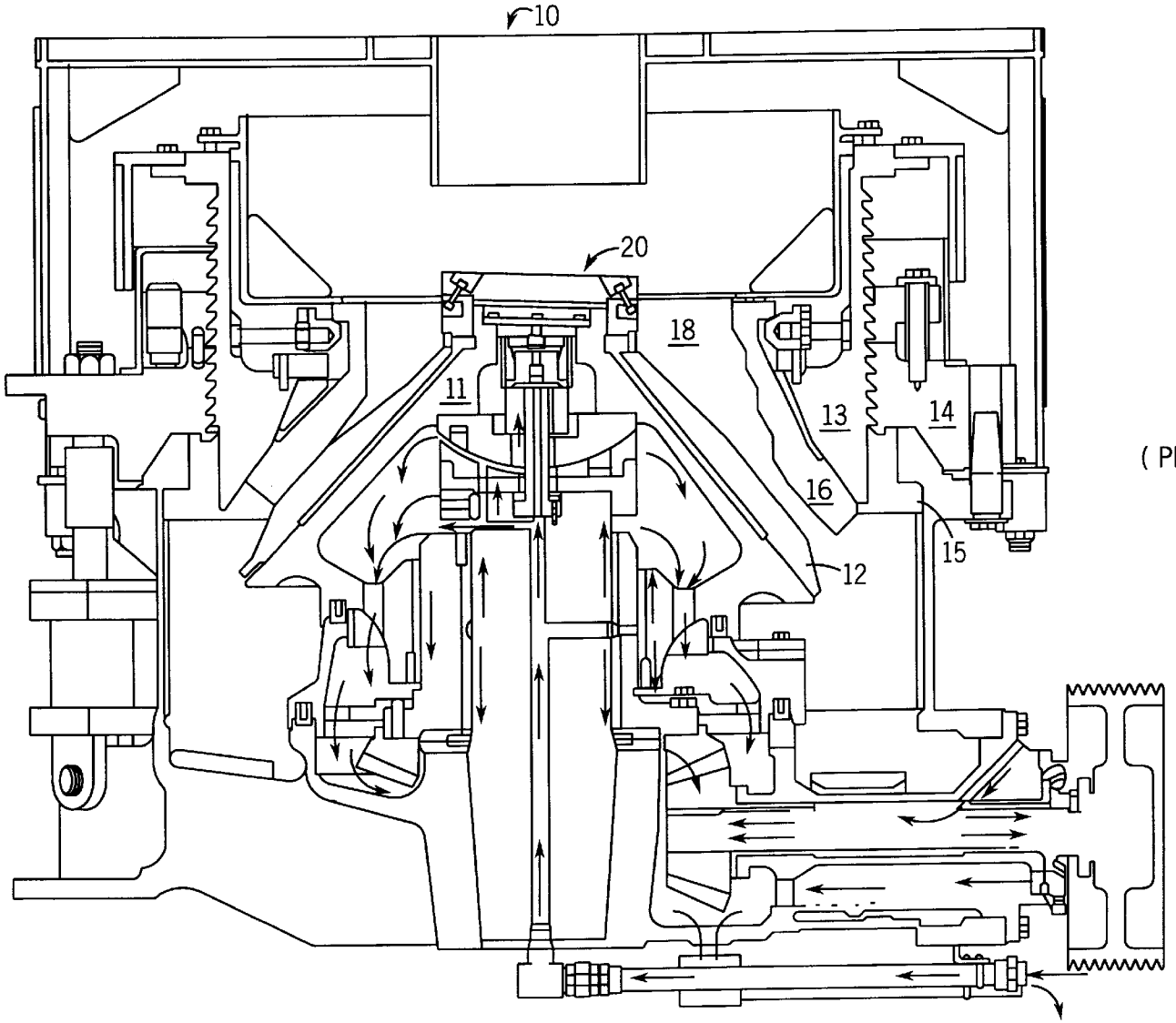
FIG. 1 ( PRIOR ART )
Figure 2:
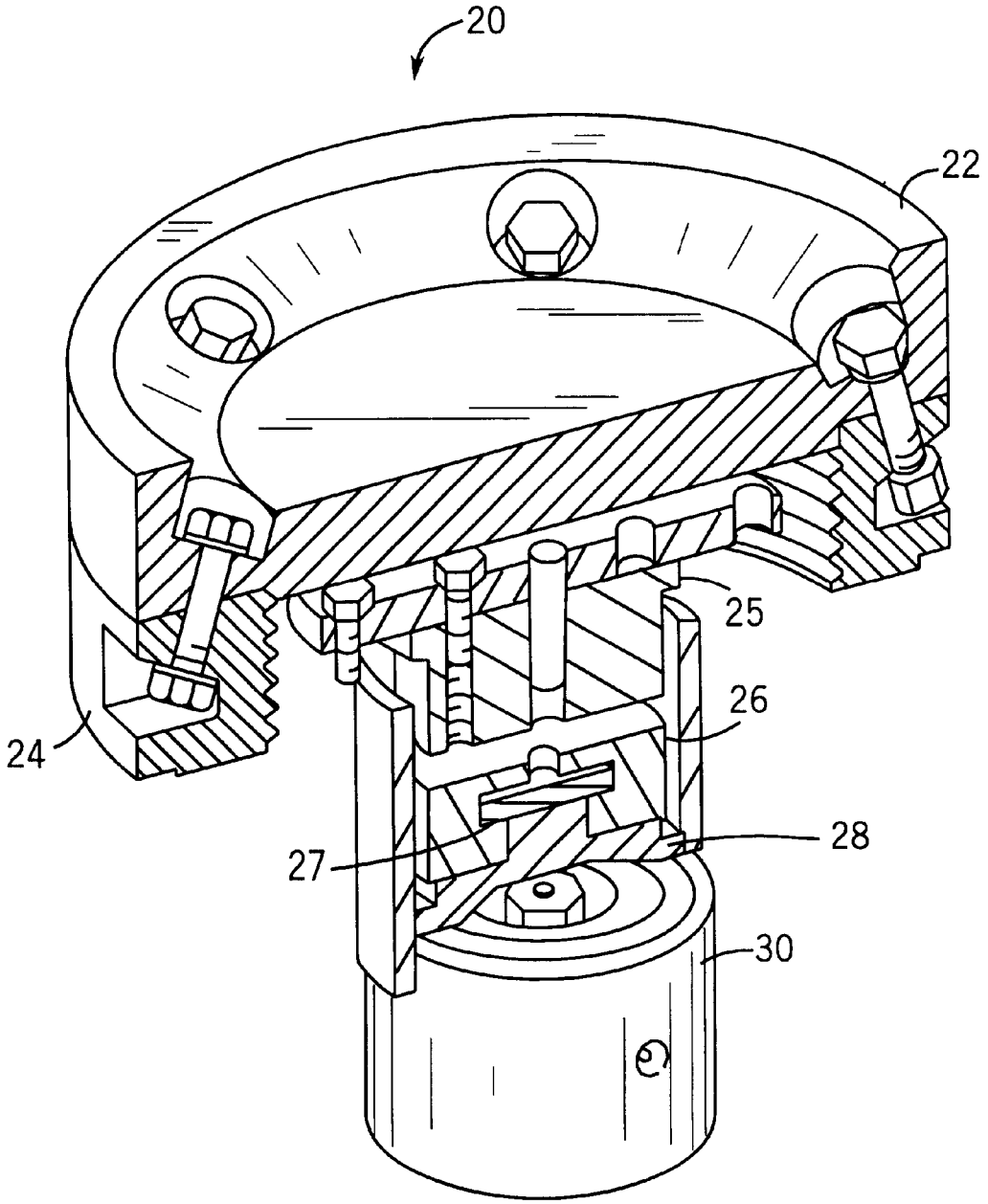
FIG. 2 ( PRIOR ART )
Figure 3:
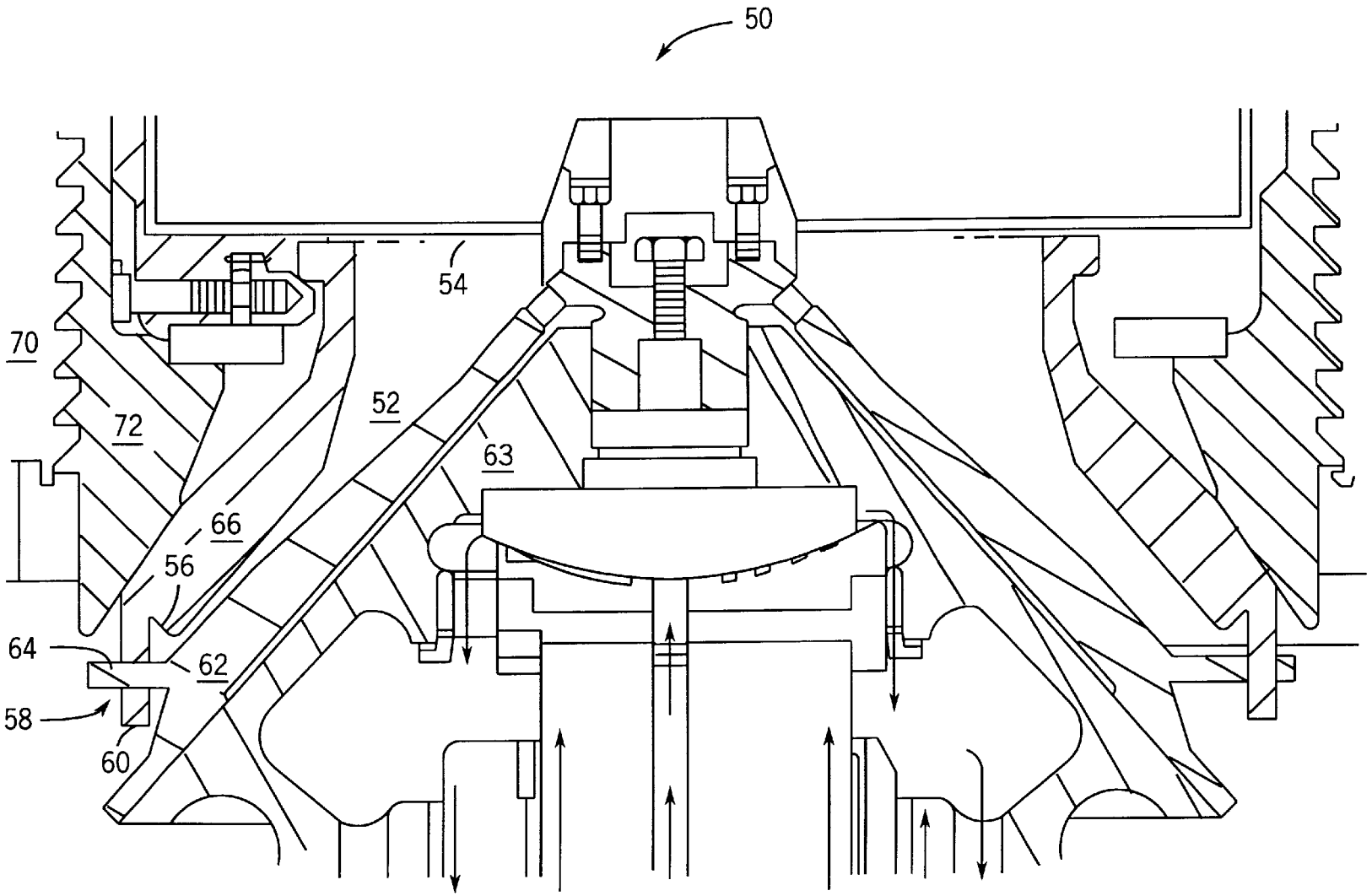
FIG. 3 is a cross-sectional view of a conical crusher, such as, an HP® crusher, manufactured by Nordberg, Inc., having an anti-spin mechanism in accordance with an exemplary embodiment of the present invention.

With reference to FIG. 3, a crushing system 50 is configured similarly to a HP® conical crusher, manufactured by Nordberg, Inc. System 50 includes a mantle 62 disposed on a crushing head 63 and a bowl liner 66 disposed on a bowl 72. Bowl 72 is threadably engaged onto an annular ring 70, which is fixed to a main frame of system 50. Material entering crusher 50 through a top end 54 of crushing gap 52 is crushed between bowl liner 66 and mantle 62 and exits at a bottom end 56 of crushing gap 52. System 50 has suitable means to hold mantle 62 and liner 66 firmly so they cannot loosen themselves during crushing. Mantle 62 and bowl liner 66 advantageously include a finger 64 and a finger 60, respectively, to form an anti-spin apparatus or mechanism 58.

Fingers 60 and 64 are disposed vertically and horizontally, respectively, on liner 66 and mantle 62. Alternatively, the horizontal and vertical nature can be changed and fingers 60 and 64 can be disposed at angles (e.g., in any manner in which fingers 60 and 64 engage or contact each other to prevent spinning action). Additionally, fingers 60 and 64 can provide the added benefit of increasing the communication action associated with the material being crushed in crushing gap 52.

Anti-spin mechanism 58 preferably includes at least one set of fingers 60 and 64. Preferably, from two to four fingers are circumferentially disposed equidistant along the periphery of mantle 62 and liner 66. Since mechanism 58 is disposed closer to a bottom end 56 of crushing gap 52 than to a top end 54, mechanism 58 does not interfere with the crushing action of system 50. Alternatively, fingers 60 and 64 can be attached to the main frame, to the crusher head, or to any other location on system 50 wherein one part is on a gyrating component and the other part is on a non-moving component.

Fingers 60 and 64 are preferably integral with bowl 66 and mantle 62, respectively, and are produced from a wear-resistant material. Fingers 60 and 64 can be shaped like hooks or ovals to ease handling of mantle 62 and liner 66. For a cone crusher of about 38 inch head size, four sets of fingers are expected to work well for all practical closed side settings up to two inches, and eccentric throws of about 1.5 to 2.4 inches with corresponding eccentric speeds in the range of 300–450 rpm. In this case, dimensions of fingers 60 (height×width×depth, respectively) are 5×3×3 inch, respectively, and dimensions of fingers 64 are 3×3×3 inches, respectively. The width of finger 64 should not be such as to significantly restrain material discharged from the cavity. Alternatively, fingers 64 could be designed with a profiled top edge to prevent rock build-up or enhance autogenous lining by a small layer of crushed material. The dimensions of fingers 60 and 64 can be adjusted for characteristics of system 50, such as, throw, radius, speed, size, and application of system 50.

Figure 4:
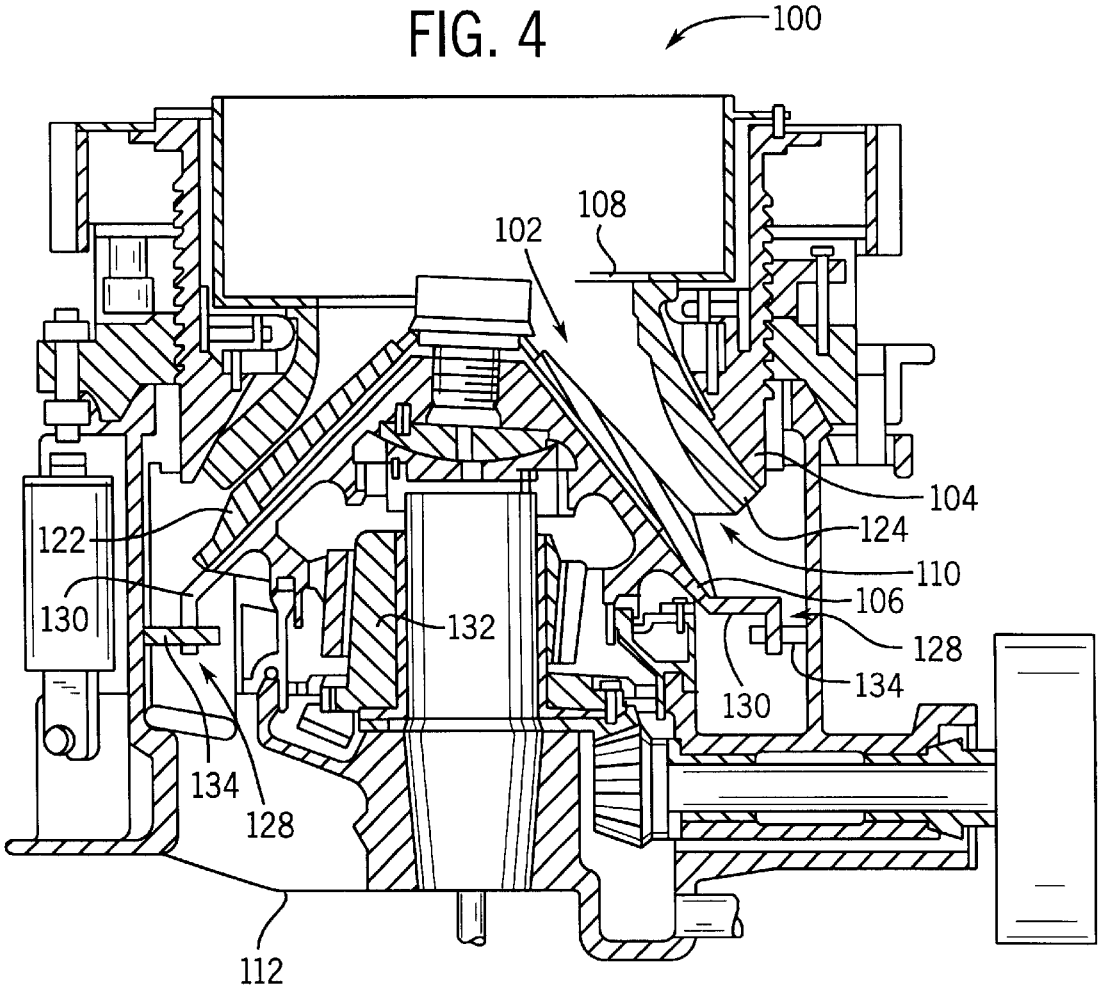
FIG. 4 is a cross-sectional view of another conical crusher, such as, an MP™ crusher manufactured by Nordberg, Inc. having an anti-spin mechanism in accordance with another exemplary embodiment of the present invention.

With reference to FIG. 4, a conical rock crusher 100 is similar to a MP™ crusher manufactured by Nordberg, Inc. and has a crushing cavity or gap 102 between a bowl 104 and a crushing head 106. Crusher 100 is drawn in FIG. 4 as a short head crusher on the left side and as a standard crusher on the right side to show that the invention can be utilized in either form of the crusher.

Gap 102 has a top end 108 where rock or other material to be crushed is received and a bottom end 110 where crushed material exits. Bowl 104 can be covered by a bowl liner 124, and head 106 can be covered by a mantle 122. As an eccentric mechanism 132 rotates, head 106 gyrates to crush material in crushing gap 102. Head 106 is prevented from spinning with respect to bowl 104 by anti-spin mechanism 128.

Anti-spin mechanism 128 is comprised of a rib or finger 130 extending from head 106 and a rib or finger 134 extending from a mainframe 112 of crusher 100. Fingers 130 and 134 can be welded or cast integrally to head 106 and to frame 112, respectively. Fingers 130 and 134 can be shaped like hooks or other attachment devices to ease transportation and handling of crusher 100.

Fingers 130 and 134 co-act or engage each other to mechanically prevent undesirable spinning action. In particular, finger 130, which is fixed with respect to mantle 122 on head 106, engages finger 134 to prevent head 106 from spinning with respect to bowl 104. Finger 134 is fixed with respect to liner 124, bowl 104, and mainframe 112. Fingers 130 and 134 are sized so as to contact each other when head 106 rotates with respect to bowl 104 and yet allow easy assembly of crusher 100. Fingers 130 and 134 are preferably spaced apart an equal distance along the periphery of head 106 and frame 112, respectively. At least one finger 130 and finger 134 can be utilized in mechanism 128 and, preferably, from two to four pairs of fingers 130 and 134 are utilized. Fingers 130 and 134 are made from a suitable wear material steel, such as, manganese metal, and can be attached to mantle 122, liner 124, head 106, bowl 104, or frame 112.

With reference to FIG. 5, another type of conical crusher 140 is shown having an anti-spin mechanism 142. Anti-spin mechanism 142 is similar to mechanisms 58 (FIG. 3) and (FIG. 4) 128 and is attached to a mainframe 146 and a crushing head 148. Mechanism 142 is shown in more detail in FIGS. 6 and 7, including a finger 150 and a finger 152. Fingers 150 and 152 can be welded or cast as part of frame 146 and of head 148, respectively. Fingers 150 and 152 are preferably check mark-shaped to increase the amount of surface area between frame 146 and head 148, respectively (FIGS. 6 and 7).

Figure 8:
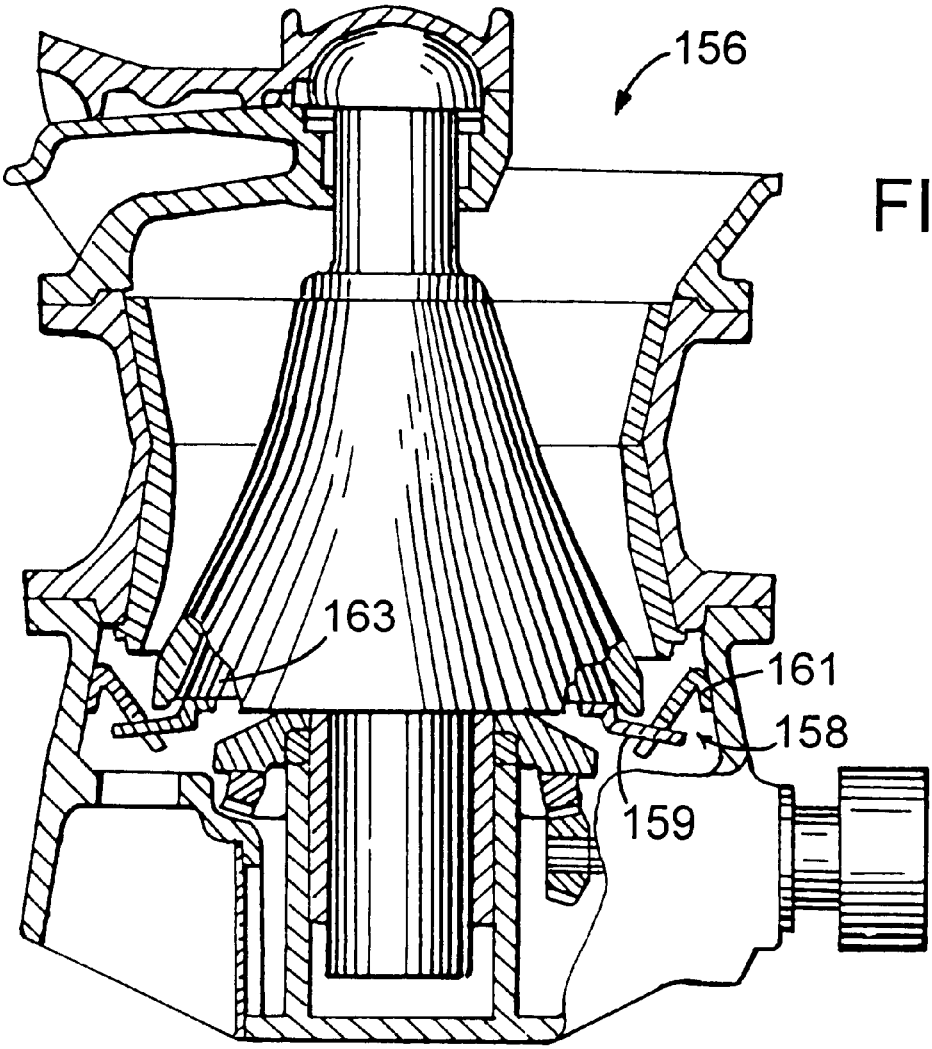
FIG. 8 is a cross-sectional view of yet still another conical crusher having an anti-spin mechanism in accordance with an exemplary embodiment of the present invention.

With reference to FIG. 8, another type of crusher 156 includes an anti-spin mechanism 158 similar to anti-spin mechanisms 58, 128, and 142 discussed with reference to FIGS. 3–7. Mechanism 158 includes fingers 159 and 161. Finger 159 is attached to a bottom of a crushing head 163.

Figure 9:
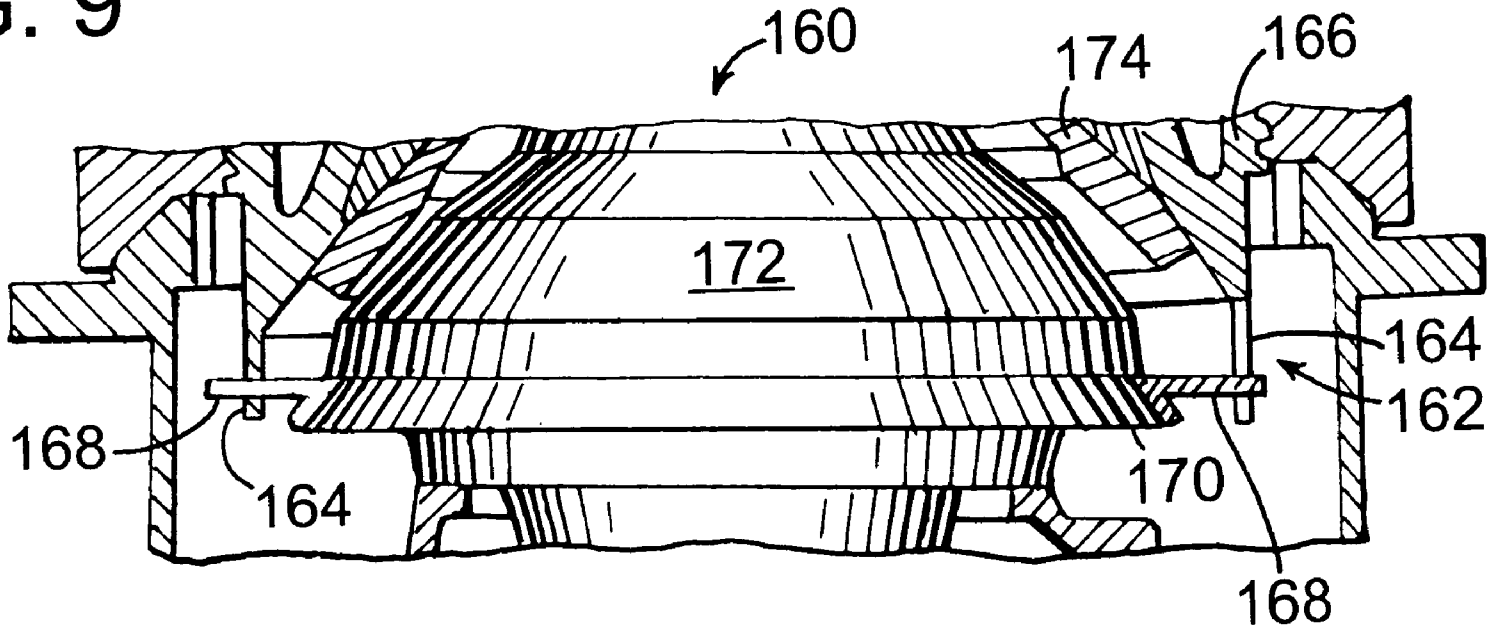
FIG. 9 is a cross-sectional view of further still another conical crusher having an anti-spin mechanism in accordance with an exemplary embodiment of the present invention.

With reference to FIG. 9, another type of crusher 160 includes an anti-spin mechanism 162 similar to mechanisms 58, 128, 142, and 158. Anti-spin mechanism 162 includes a finger 164 extending vertically downward from a bowl 166 and a finger 168 extending horizontally from a crushing head 170. Alternatively, fingers 168 and 164 can be disposed on a mantle 172 and a bowl liner 174, respectively.

Figure 10:
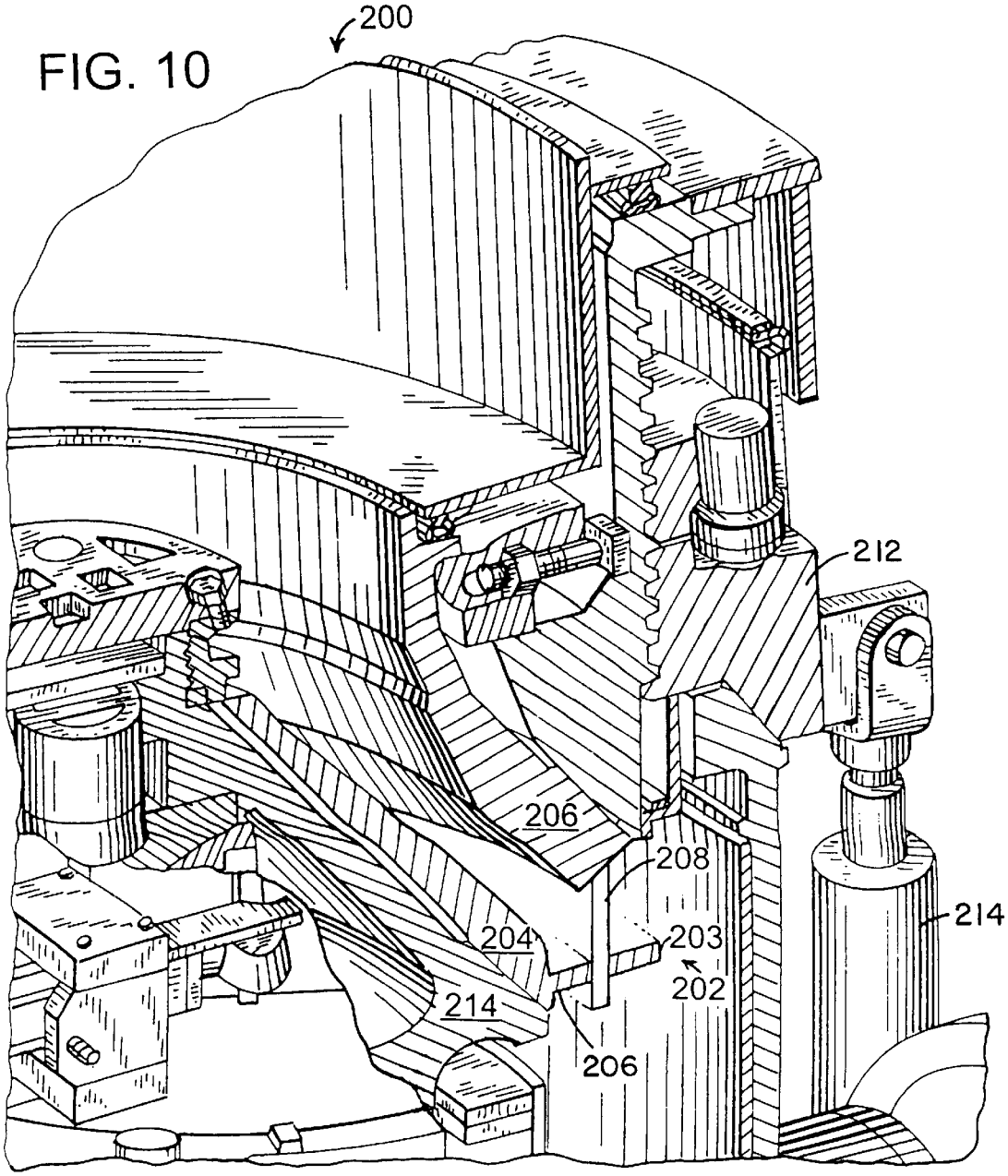
FIG. 10 is a cross-sectional view of even further still another conical crusher, such as a WaterFlush® crusher, manufactured by Nordberg, Inc. having an anti-spin mechanism in accordance with an exemplary embodiment of the present invention.

With reference to FIG. 10, a partial cross-sectional view of a WaterFlush® crusher 200 manufactured by Nordberg, Inc., includes an anti-spin mechanism 202 similar to mechanisms 58, 128, 142, 158, and 162 and provided on a mantle 204 and a bowl liner 206. Anti-spin mechanism 202 is comprised of a horizontally disposed finger 203 and a vertically disposed finger 208. The radius of mantle 204 with finger 203 is preferably less than the full inner radius of an adjustment ring 212 and clamping ring 213 so mantle 204 can be placed on crushing head 214 without the need to fully remove rings 212 and 213. With such a crusher 200, mantle 204 can be advantageously replaced without dismantling rings 212 and 213 and a pneumatic jack 215.

Figure 11:
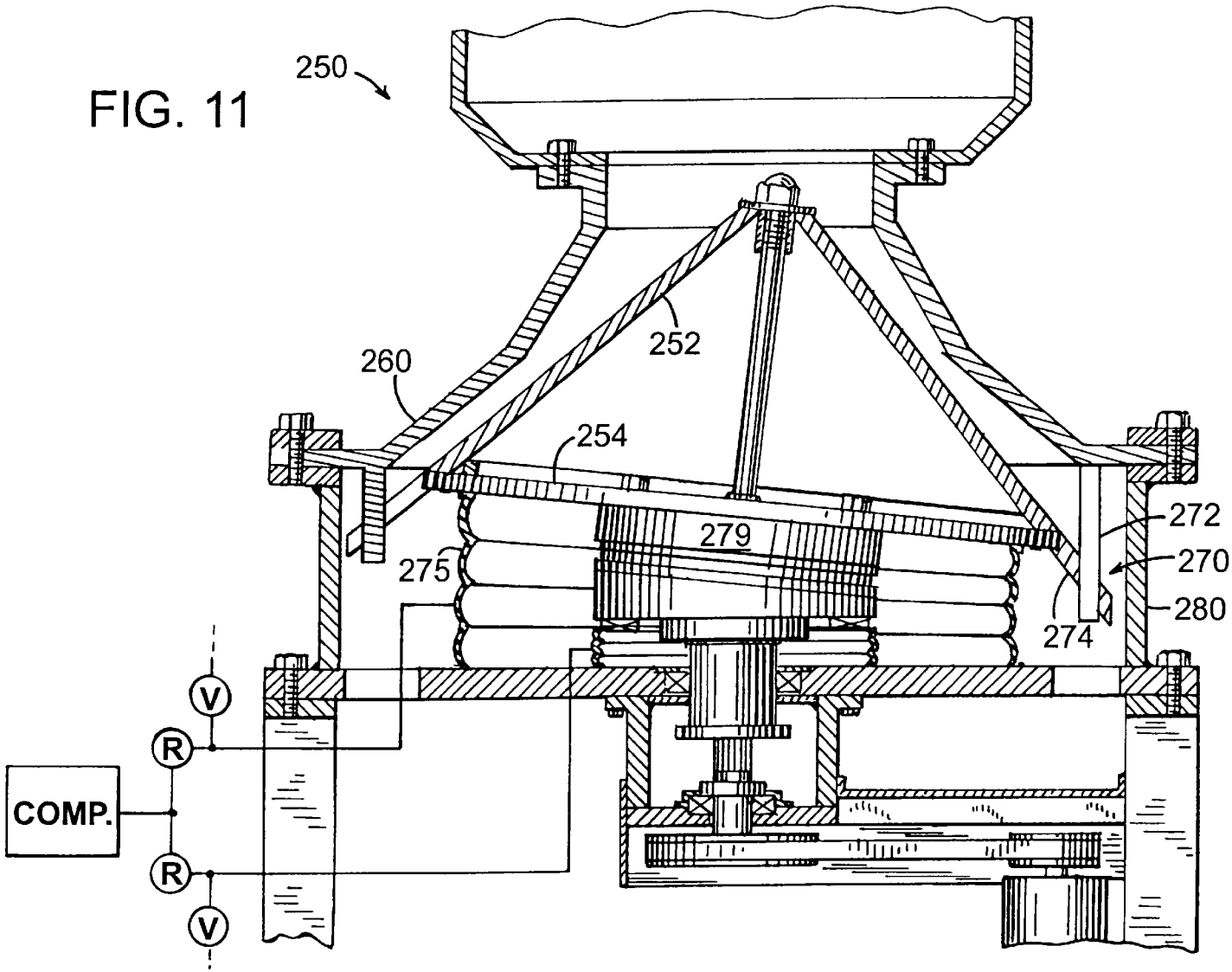
FIG. 11 is a cross-sectional view of yet another conical crusher having an anti-spin mechanism in accordance with an exemplary embodiment of the present invention.

With reference to FIG. 11, a crushing system 250 includes a one-piece mantle 252 and a one-piece bowl liner 260. Mantle 252 is disposed on a plate 254. An anti-spin mechanism 270 is disposed at a bottom of the crushing gap between mantle 252 and liner 260. Mechanism 270 is similar to mechanisms 58, 128, 142, 158, 162, and 202 and includes a vertically disposed finger 272 and a slanted finger 274. Finger 274 can be attached to mantle 252 or to plate 254. Finger 272 can be attached to liner 260 or to a mainframe 280. Alternatively, mainframe 280 could include a slanted finger disposed to engage finger 274. In yet another alternative, frame 280 can include an aperture or hole for receiving finger 274. Therefore, a number of different configurations can be utilized so mechanism 270 prevents mantle 252 from rotating with respect to bowl liner 260. Bellows 275, serve to protect bearing 279 and can also prevent spinning of mantle 252 with respect to liner 260. However, bellows 275 can be manufactured from a lighter material if mechanism 270 is employed.

Figure 12:
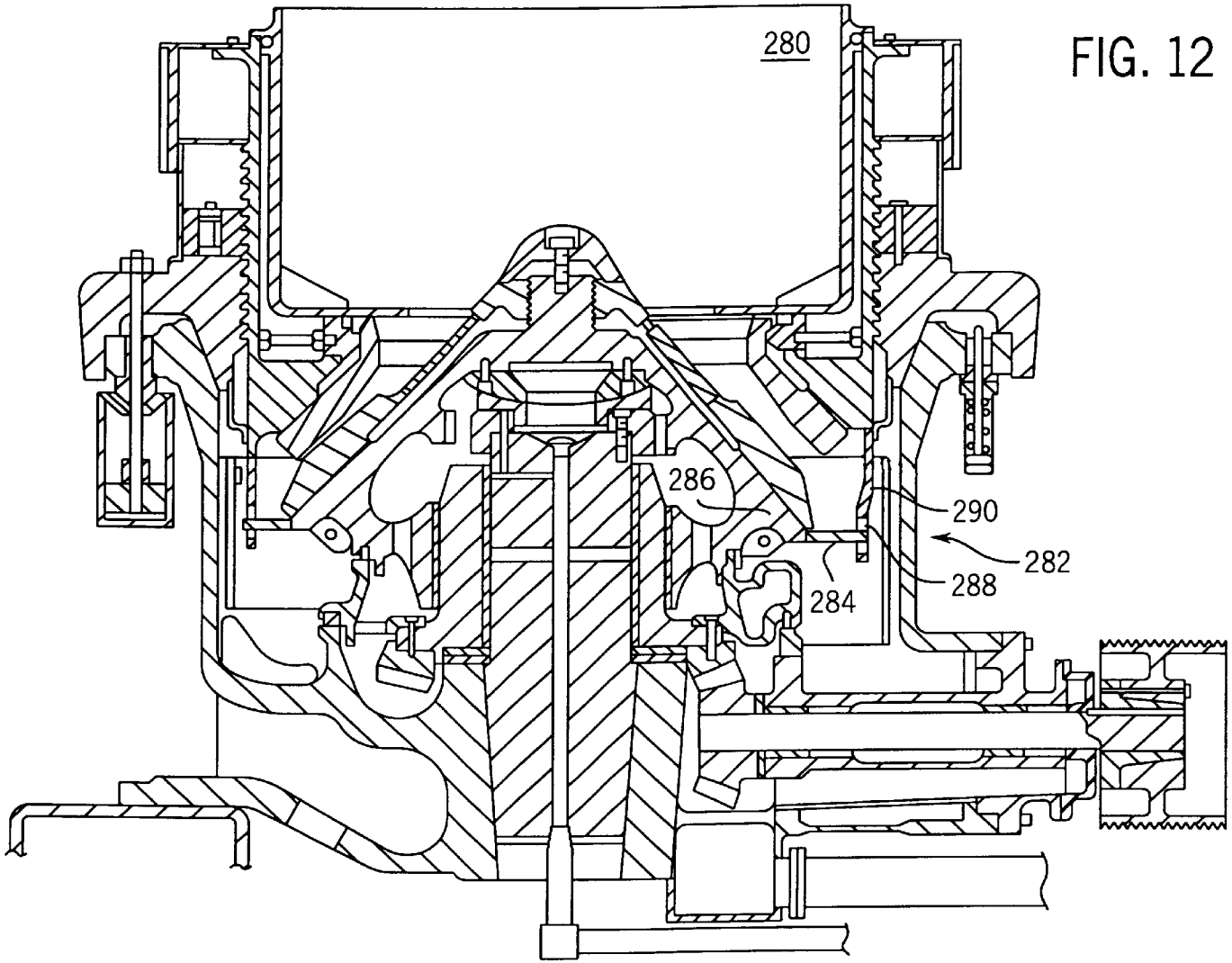
FIG. 12 is a cross-sectional view of still another conical crusher having an anti-spin mechanism in accordance with an exemplary embodiment of the present invention.

With reference to FIG. 12, a rock crusher 280 has an anti-spin mechanism 282 which is similar to mechanisms 58, 128, 142, 158, 162, 202, and 270. Mechanism 282 includes a finger 284 disposed on a head 286 and an aperture 288 in a finger 290 associated with a bowl 292. Finger 284 can co-act with aperture 288 or finger 290 to prevent head 286 from spinning with respect to bowl 292.

Mechanisms 58, 128, 142, 158, 162, 202, 270, and 282 are all located closer to a bottom end of the crushing gap as opposed to the top end of the crushing gap and are preferably not located on top of the crusher head. In this way, movement of rock and feed size openings is not constrained by the placement of the anti-spin mechanism. Anti-spin mechanisms 58, 128, 142, 158, 162, 202, 270, and 282 are generally located in the proximity of bottom end 56 of gap 52 (FIG. 3). By placing the anti-spin mechanisms 58, 128, 142, 158, 162, 202, 270 and 282 integrally with the bowl liner and the mantle, the spin mechanism (such as, mechanism 58) can be advantageously retrofit whenever the bowl liner and the mantle are replaced. Additionally, if mechanisms 58, 128, 142, 158, 162, 202, 270, and 282 break, they can be advantageously replaced the next time a mantle or a bowl liner is needed. This ensures crusher operational safety and improved wear performance during start-up and shutdown operating situations of the crusher and also during fine feed or partially loaded cavity conditions.

The various embodiments shown and described demonstrate that the anti-spin mechanism in the present invention can be located integrally (cast with another component) or attached to a variety of components of the rock crushers. Additionally, many different types of conical or gyratory rock crushers can utilize the anti-spin mechanism as is demonstrated by the various examples given. For example, the anti-spin mechanism in the present invention can be applied to any type of cone or gyratory rock crusher and any manufacturer of such crushers. Also, the anti-spin mechanism can take a variety of shapes and sizes that prevent the crusher head from spinning with respect to the bowl of the rock crusher. For example, rectangular ribs or fingers are shown. However, other shapes are possible. Indeed, conical fingers, cylindrical fingers, or other types or ribs may be utilized. Further still, an aperture and rib combination can also be utilized without departing from the scope of the present invention.

Conventional clutch-based anti-spin mechanisms permit counter-rotational motion of the head during the crushing operation. If such an action is desired, either one of fingers 60 and 64, preferably fingers 60, can be attached by means of a hinge to the liner or mantle, such that during the crushing operation, fingers 60 cannot restrain fingers 64 in the counter-rotational direction. Such a hinged arrangement may provide additional wear life to the liners. Further still, the anti-spin mechanism can be manufactured from a variety of materials.

The anti-spin mechanisms discussed with reference to FIGS. 3–12 operate by preventing the crushing head of the rock crusher from rotating more than once with respect to the bowl. The anti-spin mechanism directly mechanically obstructs (as opposed to frictionally) the rotation of the conical head with respect to the bowl of the rock crusher without the use of a top-end, clutch-based mechanism. By preventing such rotation, the crushing head is not able to gain enough speed so as to cause the fingers associated with the anti-spin mechanism to break off. Contrary to conventional belief, the spinning force, if contained within one rotation, is not great enough to break the fingers or ribs associated with the anti-spin mechanism. Additionally, since the anti-spin mechanism still allows the head to gyrate with respect to the eccentric mechanism, it does not interfere with servicing of the rock crusher, such as, when mantles are replaced.

While several embodiments and component variations of the invention have been shown, it should be apparent to those skilled in the art that what has been described is considered to be of preferred exemplary embodiments of this invention. Accordingly, changes may be made to the anti-spin mechanisms described herein without departing from the true spirit and scope of the invention. The appended claims are intended to cover all such changes and modifications which fall within the true spirit and scope of this invention.

What is claimed is:

1. A bowl liner for a rock crusher, the rock crusher including a crusher head and a bowl, the crusher head gyrating to crush a material provided to a crushing gap between the crusher head and the bowl, the material entering the crushing gap from a top end and leaving the crushing gap from a bottom end, the rock crusher having at least one crusher anti-spin element fixed with respect to the crusher head, the bowl liner comprising:

a surface protecting the bowl; and at least one bowl anti-spin element disposed to engage the at least one crusher anti-spin element when the bowl liner covers the bowl, the at least one bowl anti-spin element preventing the crusher head from spinning with respect to the bowl.

2. The bowl liner of claim 1, wherein the at least one bowl anti-spin element is a finger.

3. The bowl liner of claim 1, wherein the at least one bowl anti-spin element is a rectangular shaped finger.

4. The bowl liner of claim 1, wherein the at least one bowl anti-spin element is a finger extending vertically downward.

5. The bowl liner of claim 4, wherein the at least one finger extends from a bottom edge associated with the surface of the bowl liner.

6. The bowl liner of claim 1, wherein the at least one bowl anti-spin element is a set from two to eight projections spaced apart approximately equal distance about a periphery of the bowl liner.

7. The bowl liner of claim 1, wherein the at least one bowl anti-spin element is integrally cast with the surface.

8. The bowl liner of claim 1, wherein the at least one bowl anti-spin element is welded to the surface.

9. A mantle for a rock crusher, the rock crusher including a crusher head and a bowl, the crusher head gyrating to crush a material provided to a crushing gap between the crusher head and the bowl, the rock crusher having at least one crusher anti-spin element fixed with respect to the bowl, the mantle comprising:

a surface protecting the crusher head; and at least one mantle anti-spin element disposed to engage the at least one crusher anti-spin element when the mantle covers the crusher head, the at least one mantle anti-spin element preventing the crusher head from spinning with respect to the bowl.

10. The mantle of claim 9, wherein the at least one mantle anti-spin element is a finger.

11. The mantle of claim 10, wherein the finger extends radially with respect to a center axis of the mantle.

12. The mantle of claim 11, wherein an outer radius of the mantle including the finger is less than an interior radius of a frame ring adjacent to the bowl.

13. The mantle of claim 9, wherein the at least one mantle anti-spin element is a set from two to eight fingers spaced apart approximately equal distance about a periphery of the mantle.

14. The mantle of claim 9, wherein the at least one mantle anti-spin element is welded to the surface.

15. The mantle of claim 9, wherein the at least one mantle anti-spin element is integrally cast with the surface.

16. An anti-spin apparatus for a rock crusher including a crusher head and a bowl, the crusher head gyrating within the bowl to crush material in a crushing gap, the anti-spin apparatus comprising:

a first anti-spin element fixed with respect to the bowl; and a second anti-spin element fixed with respect to the crusher head, wherein the first anti-spin element and the second anti-spin element are configured to engage each other to prevent the crusher head from spinning with respect to the bowl.

17. The apparatus of claim 16, wherein the first crusher anti-spin element is fixed to a bowl liner and the second anti-spin element is fixed to a mantle.

18. The apparatus of claim 16, wherein the first anti-spin element and the second anti-spin element are welded to the bowl liner and mantle, respectively.

19. An anti-spin apparatus for use in a rock crusher comprising:

a bowl;

a crusher head disposed in the bowl, wherein a crushing space is located between the bowl and the crusher head; and an anti-spin apparatus comprising at least one radial projection, the at least one radial projection preventing rotation of the crusher head with respect to the bowl in at least one direction.

20. The apparatus of claim 19 further comprising:

a mantle disposed over the crusher head, wherein the at least one radial projection is attached to the mantle.

21. The rock crusher of claim 19 further comprising:

a bowl liner disposed over the bowl, wherein the at least one radial projection is attached to the bowl liner.

* * * * *